US009718586B2

(12) United States Patent
Yazdani

(10) Patent No.: US 9,718,586 B2
(45) Date of Patent: Aug. 1, 2017

(54) ADHESIVE TUBE-DISPENSER

(71) Applicant: Ataollah Yazdani, Beaverton, OR (US)

(72) Inventor: Ataollah Yazdani, Beaverton, OR (US)

( * ) Notice: Subject to any disclaimer, the term of this patent is extended or adjusted under 35 U.S.C. 154(b) by 0 days.

(21) Appl. No.: 14/849,192

(22) Filed: Sep. 9, 2015

(65) Prior Publication Data

US 2017/0066562 A1 Mar. 9, 2017

(51) Int. Cl.

| | |
|---|---|
| ***B65D 35/38*** | (2006.01) |
| ***B65D 35/44*** | (2006.01) |
| ***B65D 81/36*** | (2006.01) |
| ***B65D 47/26*** | (2006.01) |

(52) U.S. Cl.
CPC ..... *B65D 35/38* (2013.01); *B65D 35/44* (2013.01); *B65D 47/263* (2013.01); *B65D 81/366* (2013.01)

(58) Field of Classification Search
CPC ..... B65D 35/38
USPC ..... 222/478, 482, 92, 107
See application file for complete search history.

(56) References Cited

U.S. PATENT DOCUMENTS

| | | | | |
|---|---|---|---|---|
| 2,272,260 A * | 2/1942 | Ballentine | B65D 47/261 | 222/482 |
| 2,628,746 A * | 2/1953 | James | B65D 35/38 | 222/486 |
| 3,236,417 A * | 2/1966 | Linton | B65D 47/12 | 222/179.5 |
| 3,591,053 A * | 7/1971 | Thomas | B65D 35/38 | 222/482 |
| 5,505,337 A * | 4/1996 | Littman | B65D 35/38 | 222/185.1 |
| 6,193,114 B1 * | 2/2001 | Hopkins | B65D 47/12 | 222/330 |
| 6,253,958 B1 * | 7/2001 | Coletti | B65D 47/06 | 222/1 |
| 2011/0031274 A1 * | 2/2011 | Shih | B65D 1/06 | 222/92 |
| 2013/0341365 A1 * | 12/2013 | Ryan | B65D 35/38 | 222/482 |
| 2014/0374442 A1 * | 12/2014 | Nazarian | B65D 35/38 | 222/92 |

* cited by examiner

*Primary Examiner* — Donnell Long
(74) *Attorney, Agent, or Firm* — Arjomand Law Group, PLLC

(57) ABSTRACT

Articles of manufacture ("glue-tubes") are disclosed for dispensing of sticky and/or curable substances. In various embodiments each glue-tube has at least two dispensing ports. Additional ports may be used anytime that a port is obstructed by the dried or cured substance. In some embodiments the dispensing ports may be stacked on top of each other or may be placed side by side or be located at different parts of the glue-tube. In some other embodiments the dispensing ports may be colored differently or may be different in size and/or appearance. In various embodiments the dispensing ports may be opened by unscrewing, turning, pushing, pulling, lifting, or by a combination thereof. In yet other embodiments small pumps may be used to dispense the contained substance. According to the present disclosure, inexpensive multi-port dispensing heads may be manufactured separately for retrofitting any store-bought glue-tubes.

13 Claims, 5 Drawing Sheets

ADHESIVE TUBE-DISPENSER

CROSS-REFERENCE(S) TO RELATED APPLICATION(S)

This Non-Provisional application is related to U.S. Non-Provisional patent application Ser. No. 14/637,027, filed on Mar. 3, 2015, entitled "HYGIENIC TOOTHPASTE OR LOTION DISPENSER".

TECHNICAL FIELD

This application relates generally to fluid tube-dispensers. More specifically, this application relates to an apparatus for dispensing adhesives.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description often references common plastic and aluminum squeezable glue tubes with screwable caps, it will be appreciated that the disclosure may include other types of containers and dispensers of sticky and/or curable substances. In this disclosure, mostly "glue" is discussed for simplicity and the compound word "glue-tube" is used to represent the combination of a sticky and/or curable substance reservoir and its dispensing port(s).

Traditional glue-tubes have a single dispensing port which over time is clogged and obstructed by cured or dried glue that is exposed to the air outside the tube. Often when a user wants to dispense the glue, he must clean the glue-tube port by removing or by making a hole through the dried glue. Sometimes it is not possible to either remove or poke a hole through the dried glue and the user has to dispose of the glue-tube even though considerable amount of glue may still be inside. The prior art adhesive dispensers thus contribute to the waste of sizeable amount of unused substances and to the pollution of the environment.

Briefly described, articles of manufacture are disclosed for economical and efficient use of sticky and/or curable substances. In various embodiments of this disclosure, each glue-tube has at least two dispensing ports/openings, each of which may be used until clogged. In some embodiments the dispensing ports may be stacked on top of each other and in other embodiments the dispensing ports may be side by side or be located at different parts of the glue-tube. In some other embodiments the dispensing ports may be colored differently or may be different in size and/or appearance. In various embodiments the dispensing ports may be opened by unscrewing, turning, pushing, pulling, lifting, or by a combination thereof. According to the present disclosure, inexpensive multi-port dispensing heads may be manufactured separately for retrofitting any store-bought glue-tube.

Figure 1:
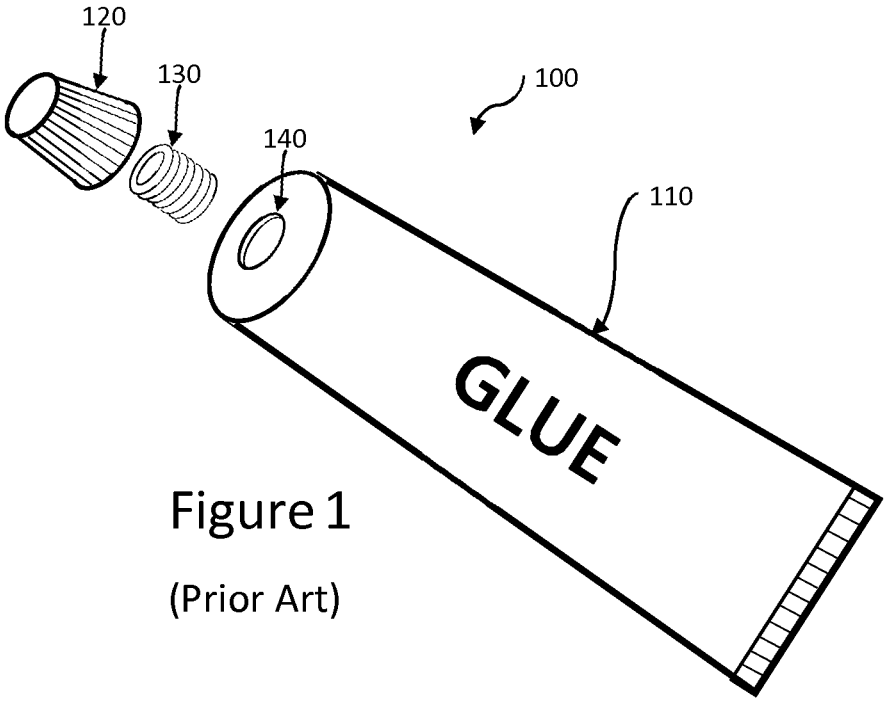
Figure 1 (Prior Art)
FIG. 1 shows an exploded view of a prior art glue dispenser.

FIG. 1 shows an exploded view of a traditional glue-tube 100 having a squeezable body 110 and a screw-on cap 120. A typical glue-tube 100 also has a neck or collar 130, on which cap 120 is screwed to close the glue-tube. Collar 130 is in turn permanently attached around an outlet opening 140 of the squeezable body 110. To use such a glue-tube, cap 120 is removed and body 110 is squeezed to force the contained substance through the outlet opening 140 and subsequently through collar 130. All users of this traditional glue-tube must continue using the same dispensing opening of collar 130, which will unavoidably be obstructed after a while.

Figure 2:
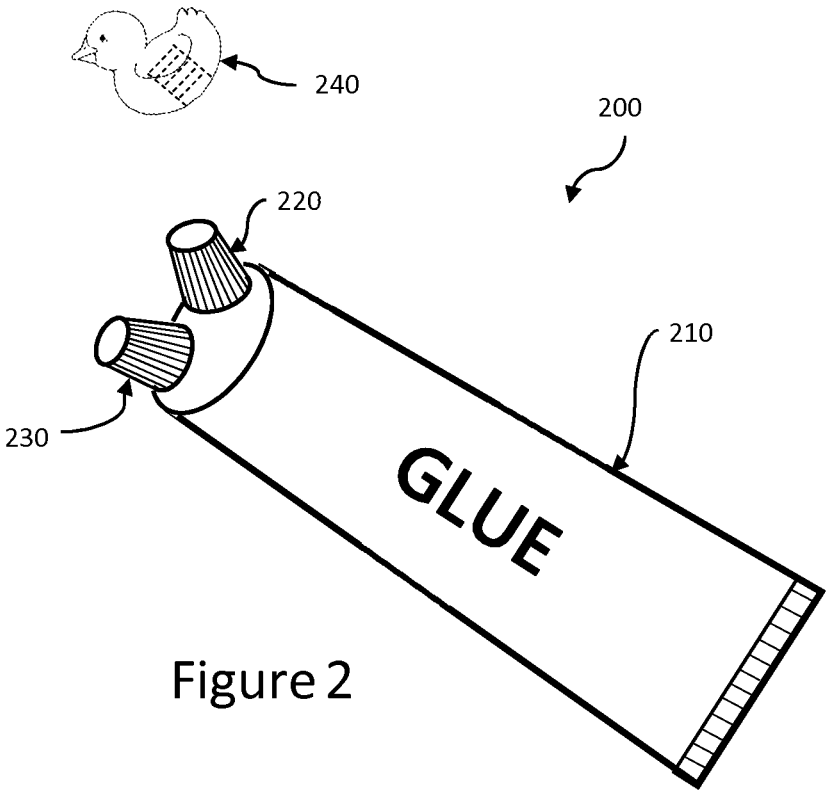
FIGS. 2-5 show disclosed examples of adhesive dispensers.

FIG. 2 illustrates an example glue-tube 200 according to an embodiment of the present disclosure. In this embodiment glue-tube 200 includes a squeezable body 210 and two side-by-side dispensing ports with screw-on caps 220 and 230. Such an example embodiment may be used twice as long as a traditional glue-tube of the same volume. In some embodiments the two caps 220 and 230 may have different colors or different designs. For example cap 240 may replace cap 220 as a reminder that the corresponding port is clogged. Caps of different designs may be sold separately for use with various embodiments of this disclosure. In various embodiments caps 220 and 230 may be replaced by small pumps to pump out the glue instead of squeezing body 210. In yet other embodiments body 210 may not even be squeezable and dispensing the contained substance may only be performed by mentioned pumps. It will be known to those skilled in the art that the multiple ports of glue-tube 200 may be manufactured on different locations of the squeezable body 210, such as both ends of the squeezable body 210.

Figure 3:
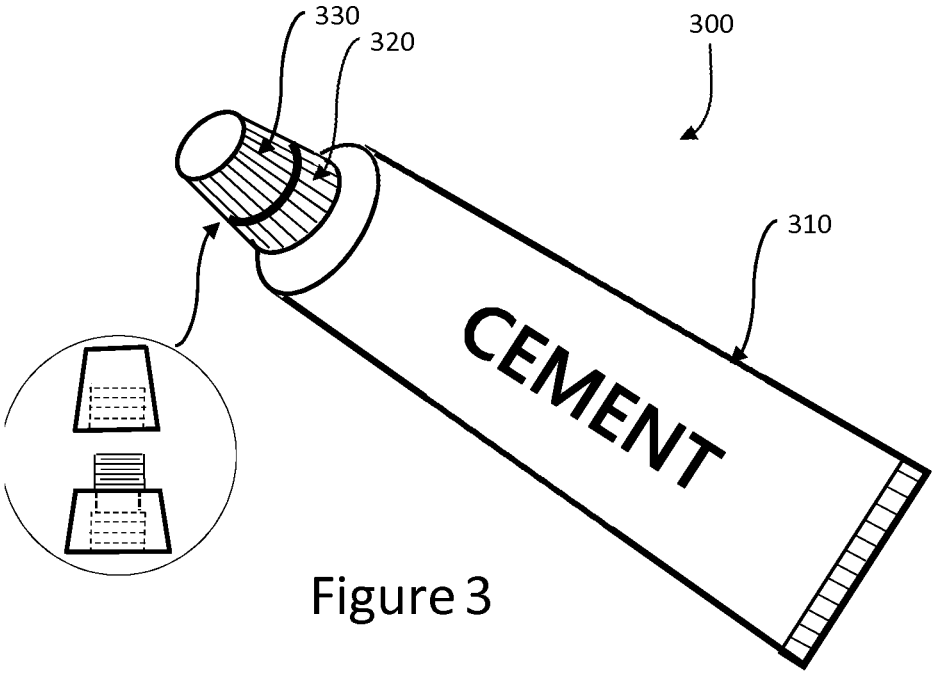

FIG. 3 illustrates an example glue-tube 300 according to another embodiment of the present disclosure. In this embodiment glue-tube 300 includes a squeezable body 310 and two stacked-up screw-on caps 320 and 330. As shown in FIG. 3, cap 320 is screwed on the collar of squeezable body 310 and cap 330 is screwed onto cap 320, which forms an alternate disposing port. Such an example embodiment may last twice as long as a traditional glue-tube of the same volume. Some embodiments may be a combination of the embodiments illustrated in FIGS. 2 and 3, wherein stacked-up caps FIG. 3 are placed on one or more collars/ports of squeezable body 210. Again, stacked-up caps of FIG. 3 may be sold separately for use with various embodiments of this disclosure and with the more traditional glue-tubes. It will be known to those skilled in the art that, if desired, more than one cap 320 may be used in the assembly of stacked-up caps.

Figure 4:
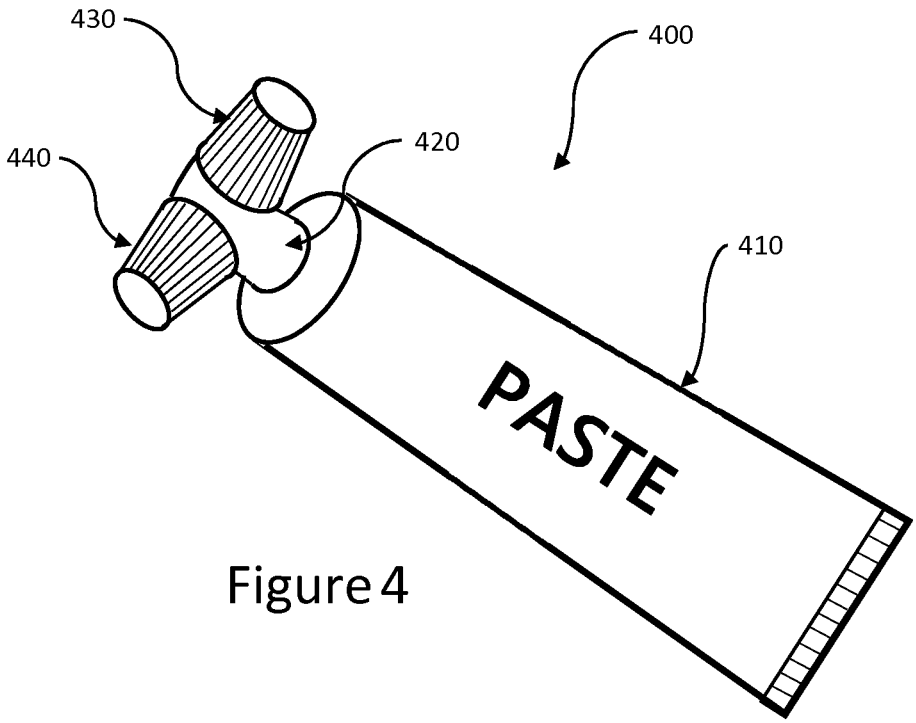

FIG. 4 illustrates yet another example glue-tube 400 according to another embodiment of the present disclosure. In this embodiment glue-tube 400 includes a squeezable body 410 and multiple screw-on caps 430 and 440, which are screwed to a dispensing port 420 of the squeezable body 410. The dispensing port 420 may itself be a non-detachable extension of the squeezable body 410 or may be screwed/attached onto a neck of the squeezable body 410. Such an example embodiment will continue dispensing glue for a long time, depending on the number of the screw-on caps. Various embodiments may use any combination of the embodiments illustrated in FIGS. 2, 3 and 4, wherein stacked-up caps FIG. 3 replace caps 430 and 440 and/or dispensing port 420 is placed on one or more ports of squeezable body 210. Again, dispensing port 420 and multiple screw-on caps 430 and 440 may be sold separately for use with various embodiments of this disclosure and with the more traditional glue-tubes. In various embodiments caps 430 and 440 may be replaced by small pumps for dispensing the paste.

Figure 5:
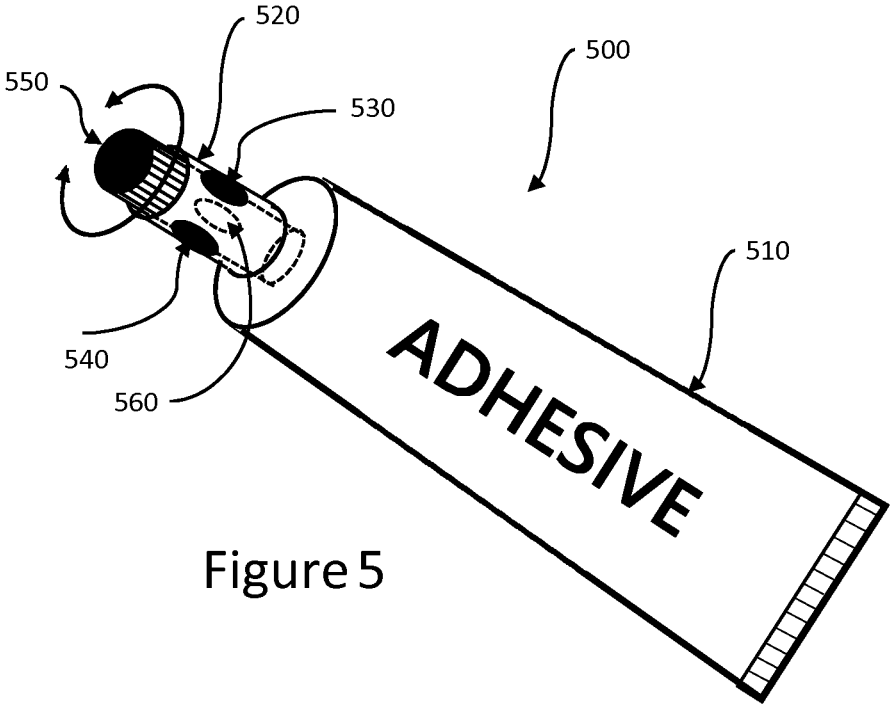

FIG. 5 illustrates yet another example glue-tube 500 according to an alternative embodiment of the present disclosure. In this embodiment glue-tube 500 includes a squeezable body 510 and a dispensing collar 520, which may be a fixed extension of the squeezable body 510 or may be attached onto the neck of the squeezable body 510. The dispensing collar 520 may have multiple dispensing ports/holes 530 and 540. Such an example embodiment also will continue dispensing the contained substance for a long time, depending on the number of the dispensing ports. As shown in FIG. 5, tube 550, which is closed at the top, has a hole 560 on its wall, and is placed in collar 520, can be turned to align hole 560 with either of the multiple dispensing ports 530 and 540. Tube 550 may be configured to be turned around or be pushed and pulled along its axis. In various embodiments, pushing down tube 550 prevents any possible alignment of hole 560 with dispensing ports 530 and 540, and pulling up tube 550 allows the alignment of hole 560 with dispensing ports 530 and 540. Various embodiments may use any combination of the embodiments illustrated in FIGS. 2, 3, 4 and 5. Again, dispensing collar 520 along with dispensing ports 530 and 540 may be sold separately for use with various embodiments of this disclosure and with the more traditional glue-tubes.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above detailed description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An adhesive dispenser cap comprising:

a first cap component attachable or permanently attached to the adhesive tube collar;

a second cap component moveably surrounding the first cap component or moveably surrounded by the first cap component, wherein the surrounded or inner cap component has one dispensing opening and the surrounding or outer cap component has more than one dispensing opening; and wherein the inner cap component opening is configured to be in fluid communication with the tube and the adhesive is dispensed from the tube by moving one cap component relative to the other cap component and aligning the dispensing opening of the inner cap component with one of the openings of the outer cap component.

2. The dispenser of claim 1, wherein the inner cap component turns inside the outer cap component or the outer cap component turns around the inner cap component.

3. The dispenser of claim 1, wherein the tube is made of plastic or aluminum or a combination of both.

4. The dispenser of claim 1, wherein the tube is squeezable or non-squeezable.

5. The dispenser of claim 1, wherein the inner cap component moves up and down relative to the outer cap component or the outer cap component moves up and down relative to the inner cap component.

6. The dispenser of claim 1, wherein the first cap component is the inner cap component.

7. The dispenser of claim 1, wherein the first cap component is the outer cap component.

8. A fluid adhesive dispenser head comprising:

a collar-cap for attaching the dispenser head to a dispensing collar of a fluid adhesive reservoir, wherein the collar-cap includes a dispensing port; and a stacked-up cap detachably covering the dispensing port of the collar-cap, wherein the stacked-up cap may or may not have a dispensing port which is configured to be covered by another stacked-up cap with or without a dispensing port, and wherein a fluid adhesive contained in the reservoir may be pushed through the collar and be dispensed from the collar and/or a desired dispenser port.

9. The fluid adhesive dispenser head of claim 8, wherein the collar-cap of the dispenser head is detachably attached to the collar.

10. The fluid adhesive dispenser head of claim 8, wherein the reservoir is made of plastic or aluminum or a combination of both.

11. The fluid adhesive dispenser head of claim 8, wherein the reservoir is squeezable or non-squeezable.

12. The fluid adhesive dispenser head of claim 8, wherein the dispensing ports are stacked on top of each other.

13. The fluid adhesive dispenser head of claim 8, wherein the dispenser head is screwed to the collar of traditional toothpaste tubes.

* * * * *